United States Patent [19]

Lemke et al.

[11] Patent Number: 4,968,278

[45] Date of Patent: Nov. 6, 1990

[54] FLOTATION PLATFORM

[76] Inventors: Sharon A. Lemke, 9075 W. Waterford Sq. N., Greenfield, Wis. 53228; Edward A. Bachmann, 4059 N. 85th St., Milwaukee, Wis. 53222

[21] Appl. No.: 346,594

[22] Filed: May 2, 1989

[51] Int. Cl.[5] ..... B63B 3/38

[52] U.S. Cl. ..... 441/129

[58] Field of Search ..... 441/35–41, 441/127–129, 136; 114/345

[56] References Cited

U.S. PATENT DOCUMENTS

| | | | |
|---|---|---|---|
| 238,119 | 2/1881 | Horton | 441/128 |
| 3,019,457 | 2/1962 | Lowery | 441/36 |
| 3,339,218 | 9/1967 | Stamberger | 441/40 |
| 4,614,500 | 9/1986 | Miller | 441/40 |
| 4,723,329 | 2/1988 | Vaccaro | 441/129 |
| 4,729,335 | 3/1988 | Vidovic | 441/40 |
| 4,747,797 | 5/1988 | Hindle | 441/40 |

FOREIGN PATENT DOCUMENTS

| | | | |
|---|---|---|---|
| 19356 | of 1913 | United Kingdom | 441/128 |

*Primary Examiner*—Sherman Basinger
*Assistant Examiner*—Jesus D. Sotelo
*Attorney, Agent, or Firm*—Leon Gilden

[57] ABSTRACT

A flotation platform is set forth comprising a first chamber of a first width underlying a superimposed upper chamber of a second width substantially twice the width of the lower chamber to enable selective inflation of the upper chamber to accommodate and effect comfort to a user while enabling inflation of the lower chamber to an elevated pressure to maintain stability of the platform. The platform further includes a perimeter cord integrally secured at the junction of the upper and lower chambers and positioned within an arcuate recess coextensive with the cord wherein the cord is of a cross-sectional area greater than the wall thickness of either lower or upper chamber. The cord anchors a series of forward handles at a forward wall of the platform and a series of lower handles at a lower series of platform to rigidly secure the handles to the cord and the platform. Each handle is provided with a spring-biased clip to enable a user to rapidly secure a tether line to the clip in lieu of the handle. The handles and clips enable the rafts to be tethered to one another or to docks and the like for ease of use and safety and securement.

5 Claims, 1 Drawing Sheet

Fig 1
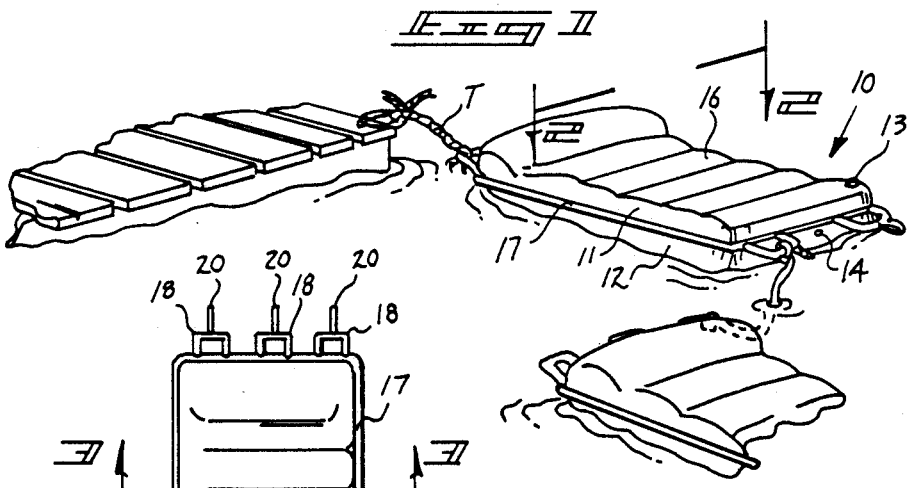
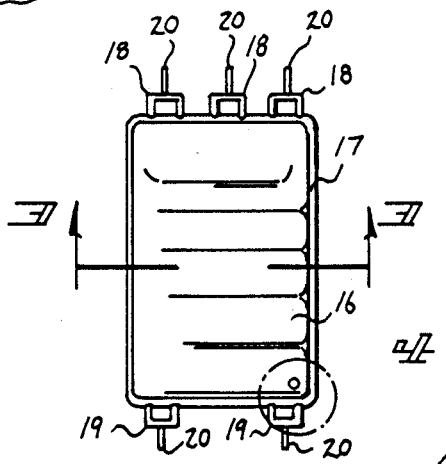
4
Fig 2
Fig 3
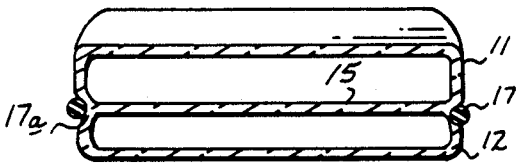
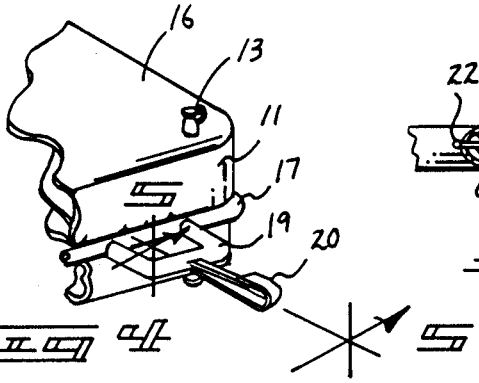
Fig 4
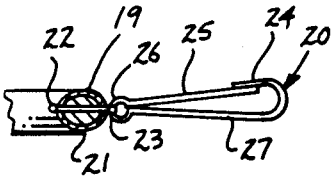
Fig 5

FLOTATION PLATFORM

BACKGROUND OF THE INVENTION

1. Field of the Invention

The field of invention relates to flotation devices, and more particularly pertains to a new and improved flotation platform wherein the same is provided with handles at upper and lower perimeters of the platform to enable rapid and safe securement of the platforms to one another and to preselected anchor sites.

2. Description of the Prior Art

The use of flotation rafts of various configurations have been utilized in the prior art. Heretofore such raft organizations have included associated limitations that prevented their easily being secured to associated anchor organizations and have lacked the coextensive overlying chambers of the instant organization to provide comfort and stability to the platform or raft organization. For example, U.S. Pat. No. 3,019,457 to Lowery sets forth a flotation device that is further provided with a roof organization to afford a level of weather protection to individuals awaiting a rescue effort in the open sea.

U.S. Pat. No. 8,829,218 to Stamberger sets forth a flotation organization utilizing a plurality of spaced pontoons with bridge members therebetween to accommodate an individual for flotation upon a water surface, or alternatively provides for various pontoon organizations in combination with a body support portion.

U.S. Pat. No. 4,614,500 to Miller sets forth a raft or platform structure with a plurality of boarding stations to enable access to the platform regardless of the orientation of the platform within a body of water.

U.S. Pat. No. 4,729,335 to Vidovic sets forth a flotation dock provided with a central dock portion and a plurality of wing portions wherein the wing portions are provided with storage compartments for flotation of a dock including the wings in the central portion.

U.S. Pat. No. 4,747,797 to Hindle provides for a retrieval flotation type device with an encompassing flotation ring in a central support sheet for support of an individual thereon.

As such, it may be appreciated that there is a continuing need for a new and improved flotation platform wherein the same addresses both the problems of ease of use and effectiveness in construction to enable stability and ready securement of the platform and in this respect, the present invention substantially fulfills this need.

SUMMARY OF THE INVENTION

In view of the foregoing disadvantages inherent in the known types of flotation platforms now present in the prior art, the present invention provides a flotation platform wherein the same affords stability and safety by utilization of a plurality of overlying flotation chambers and spaced series of tethering handles. As such, the general purpose of the present invention, which will be described subsequently in greater detail, is to provide a new and improved flotation platform which has all the advantages of the prior art flotation platforms and none of the disadvantages.

To attain this, the present invention comprises a flotation platform with an upper chamber coextensive with and overlying a lower chamber wherein the upper chamber is of a cross-sectional area greater than the lower chamber to enable the upper chamber to be deflated to effect comfort of an individual supported thereon. The lower chamber is inflatable to maintain a pressure greater than the upper chamber to afford stability to the organization. A perimeter cord of a cross-sectional area greater than the walls of the chambers is directed about the side wall of the platform for providing anchor to a plural series of handles positioned forwardly and rearwardly of the platform. The cord further provides for enhanced structural integrity to the organization as it effects a girdling of the platform. The handles are utilized for tethering of the platform to other platforms or to an anchor-type station for safety and wherein each handle is further provided with a biased clip to enable a rapid securement of a looped tether line through the clip.

My invention resides not in any one of these features per se, but rather in the particular combination of all of them herein disclosed and claimed and it is distinguished from the prior art in this particular combination of all of its structures for the functions specified.

There has been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U S Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved flotation platform which has all the advantages of the prior art flotation platforms and none of the disadvantages.

It is another object of the present invention to provide a new and improved flotation platform which may be easily and efficiently manufactured and marketed.

It is a further object of the present invention to provide a new and improved flotation platform which is of a durable and reliable construction.

An even further object of the present invention is to provide a new and improved flotation platform which is susceptible of a low cost of manufacture with regard to both materials and labor, and which accordingly is then susceptible of low prices of sale to the consuming public, thereby making such flotation platforms economically available to the buying public.

Still yet another object of the present invention is to provide a new and improved flotation platform which provides in the apparatuses and methods of the prior art some of the advantages thereof, while simultaneously overcoming some of the disadvantages normally associated therewith.

Still another object of the present invention is to provide a new and improved flotation platform wherein the same is provided with overlying chambers for stability and comfort of the platform, as well as utilizing plural series of tethering handles for securement of the device to other platforms and to anchor positions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic top view of the instant invention.

FIG. 3 is an orthographic view taken along the lines 3—3 of FIG. 2 in the direction indicated by the arrows.

FIG. 4 is an isometric illustration of section 4 of FIG. 2.

FIG. 5 is an orthographic view taken along the lines 5—5 of FIG. 4 in the direction indicated by the arrows.

DESCRIPTION OF THE PREFERRED EMBODIMENT

With reference now to the drawings, and in particular to FIGS. 1 to 5 thereof, a new and improved flotation platform embodying the principles and concepts of the present invention and generally designated by the reference numeral 10 will be described.

More specifically, it will be noted that the flotation platform apparatus 10 essentially comprises an encompassing platform formed of a flexible polymeric material defining an upper pneumatic chamber 11 coextensive with and overlying a lower pneumatic chamber 12. The upper chamber 11 is of a height substantially twice that of the lower chamber to enable the upper chamber to accept deflation to provide comfort to an individual accommodated upon the undulating upper textured surface 16 of the upper chamber 11. The upper chamber includes a first inflation valve 13 with the lower chamber including a second inflation valve 14 to enable pneumatic pressure to be directed interiorly of the respective upper and lower chambers 11 and 12. The upper and lower chambers are separated by a common wall defined in an intermediate web 15. A continuous reinforcing perimeter cord 17 is positioned and integrally fixed within an arcuate recess 17*a* which is positioned within the side wall of the flotation platform 10 adjacent the edges of the intermediate web 15. The cord 17 defined by a cross-sectional area greater than that of the wall thickness of the upper and lower chamber to provide a girdling of the side and end walls of the flotation platform 10 and further provide an anchoring for a series of forward handles 18 positioned upon the forward portion of the reinforcing cord of the forward wall of the flotation platform with a series of rear handles 19 positioned and formed to the cord at the rear end wall of the flotation platform 10, as illustrated in FIG. 2 for example. Pivotally mounted medially to the outer surface of each handle 18 and 19 respectively is a spring-biased securement clip 20 that is secured to the handle by means of an anchor cord 21 directed diametrically through the cord 17 and formed with an enlarged first end 22 to secure the anchor cord within the perimeter cord 17. The second end of the anchor cord positioned exteriorly of the cord 17 includes a ring pivot connection 23 pivotally mounting each clip 20 thereto. Each clip 20 is provided with a rigid loop 24 overlying a displaceable biased plate 25 pivotally and resiliently mounted at a rear apex 26 at the junction of a coextensive spine 27 of the clip 20.

It is understood therefore that a tethering line, as illustrated in FIG. 1 may secure a source of flotation platform to one another or to an anchor station by way of securement to each handle 18 or clip 19 or for purposes of speed, may receive a loop of the tether line directed against the displaceable bias plate 27 of the clip 20 to secure the tether line "T" within the rigid loop 24 of the clip 20.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention. to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A flotation platform comprising:

spaced elongate side walls including spaced end walls, a bottom wall, and a top wall to define a pneumatic enclosure, the top wall defined by an undulating textured surface to accommodate an individual thereon, and including a reinforcing perimeter cord coextensively and exteriorly affixed to the enclosure about the side end walls, and a plurality of securement means integrally secured to the reinforcing cord for securely receiving a tether line, and wherein the securement means each including a handle and wherein a plurality of handles are affixed to the reinforcing cord adjacent a rear end wall and a further plurality of handles affixed to the reinforcing cord adjacent a forward end wall, and wherein the walls of the enclosure are formed of flexible material and are defined by a first cross-sectional thickness and wherein the reinforcing cord is formed of a second cross-sectional thickness greater than the first cross-sectional thickness to enhance reinforcement of the enclosure, and wherein each handle further includes a clip pivotally mounted medially of each handle for receiving a tether line looped therethrough, and wherein each clip is pivotally mounted to the handle including a pivot ring securing the clip to an anchor cord directed diametrically through the handle and wherein the anchor cord is provided with an enlarged head remote from the clip and on the opposite side of the handle to prevent inadvertent withdrawal of the cord from the handle.

2. A flotation platform as set forth in claim 1, wherein the clip includes a spring-biased displaceable plate to enable the tether line loop to be directed against the plate and interiorly of the clip.

3. A flotation platform as set forth in claim 2 wherein the enclosure includes an upper pneumatic chamber and a lower pneumatic chamber, and each chamber includes an inflation valve operatively associated with each chamber.

4. A flotation platform as set forth in claim 3 including an intermediate web coextensively arranged interiorly of the enclosure to define and separate the upper pneumatic chamber from the lower pneumatic chamber and wherein the web is arranged and aligned with the reinforcing cord.

5. A flotation platform as set forth in claim 4 wherein the height of the lower pneumatic chamber is approximately half of a height defined by the upper pneumatic chamber to accommodate inflation of the upper chamber to afford comfort to an individual thereon while preserving inflation of the lower chamber to maintain flotation and stability of the platform.

* * * * *